US011280562B2

(12) United States Patent
Mazzoni et al.

(10) Patent No.: US 11,280,562 B2
(45) Date of Patent: Mar. 22, 2022

(54) HEAT EXCHANGER TANK WITH REINFORCEMENT ELEMENT

(71) Applicant: VALEO TERMICO SA. de CV, San Luis Potosi (MX)

(72) Inventors: Armando Mazzoni, San Luis Potosi (MX); Eder Nomoto, Itatiba (BR); Catalino Loredo, San Luis Potosi (MX)

(73) Assignee: VALEO TERMICO SA. de CV, San Luis Potosi (MX)

( * ) Notice: Subject to any disclaimer, the term of this patent is extended or adjusted under 35 U.S.C. 154(b) by 0 days.

(21) Appl. No.: 16/434,312

(22) Filed: Jun. 7, 2019

(65) Prior Publication Data

US 2019/0376752 A1 Dec. 12, 2019

(30) Foreign Application Priority Data

Jun. 7, 2018 (EP) ..... 18176585

(51) Int. Cl.

| | |
|---|---|
| ***F28F 9/02*** | (2006.01) |
| ***F28F 9/26*** | (2006.01) |
| ***F28F 1/10*** | (2006.01) |
| ***F28F 9/00*** | (2006.01) |
| ***F28F 21/06*** | (2006.01) |
| ***F28F 21/08*** | (2006.01) |
| *F28F 1/42* | (2006.01) |

(52) U.S. Cl.

CPC ..... *F28F 9/26* (2013.01); *F28F 1/10* (2013.01); *F28F 9/002* (2013.01); *F28F 21/06* (2013.01); *F28F 21/08* (2013.01); *F28F 2001/428* (2013.01)

(58) Field of Classification Search

CPC .... F28F 2225/08; F28F 9/0219; F28F 9/0224; F28F 9/0226

USPC ..... 165/149, 173

See application file for complete search history.

(56) References Cited

U.S. PATENT DOCUMENTS

| | | | | | |
|---|---|---|---|---|---|
| 4,351,390 | A * | 9/1982 | Argyle | F28F 9/0226 | 165/149 |
| 4,401,157 | A * | 8/1983 | Cadars | F28D 1/053 | 165/173 |
| 4,707,905 | A * | 11/1987 | Clair | F28F 9/0226 | 165/173 |
| 5,195,579 | A * | 3/1993 | Buchanan | F28F 9/0224 | 165/149 |
| 5,205,349 | A * | 4/1993 | Nagao | B60H 1/00328 | 165/153 |
| 5,845,705 | A * | 12/1998 | Vinh | F28D 1/05391 | 165/173 |

(Continued)

*Primary Examiner* — Frantz F Jules
*Assistant Examiner* — Jason N Thompson
(74) *Attorney, Agent, or Firm* — Osha Bergman Watanabe & Burton LLP

(57) ABSTRACT

A heat exchanger tank that includes external ribs that provide reinforcement to structure of the heat exchanger tank is disclosed. In addition, at least one reinforcement element may engage with an external tank portion and may be tensioned by press fitting the at least one reinforcement element on the external tank portion such that limbs of the at least one reinforcement element are separated by the external tank portion between the external ribs. The at least one reinforcement element may further be maintained in the tensioned configuration by using at least one retention means.

16 Claims, 6 Drawing Sheets

(56) References Cited

U.S. PATENT DOCUMENTS

| | | | | |
|---|---|---|---|---|
| 6,082,446 | A * | 7/2000 | Ahaus | F28F 9/0226 165/149 |
| 6,564,863 | B1 * | 5/2003 | Martins | F28D 1/05383 165/153 |
| 7,775,266 | B2 * | 8/2010 | Freitag | F28F 9/0226 165/173 |
| 2003/0221819 | A1 * | 12/2003 | Jang | F28F 9/0214 165/173 |
| 2006/0185833 | A1 * | 8/2006 | Brost | F28F 9/0224 165/149 |
| 2009/0095458 | A1 * | 4/2009 | Lim | F28F 9/0224 165/174 |
| 2011/0168364 | A1 * | 7/2011 | Okuyama | F28F 9/0226 165/148 |
| 2012/0000638 | A1 * | 1/2012 | Cipriani | F28D 9/0006 165/185 |
| 2016/0010931 | A1 * | 1/2016 | Somhorst | F28F 9/02 165/173 |

* cited by examiner

HEAT EXCHANGER TANK WITH REINFORCEMENT ELEMENT

CROSS-RELATED APPLICATIONS

This Application claims priority from Application 18176585.0 filed on Jun. 7, 2018 in European Patent Office. The entire contents of these applications are incorporated herein by reference in their entirety.

FIELD OF DISCLOSURE

The present disclosure relates to a heat exchanger, particularly, the present disclosure relates to a heat exchanger tank for the heat exchanger.

BACKGROUND

Conventional heat exchanger generally includes a pair of spaced apart headers, formed on end portions of a heat exchanger core configured of a plurality of heat exchange elements and a plurality of fin elements formed on the heat exchanger elements. The heat exchange elements connect the headers and configure adjacent yet separated spaces between the headers for facilitating heat exchange between heat exchanging fluids flowing through the respective separated spaces and the heat exchange elements. The heat exchanger further includes a pair of heat exchanger tanks, hereinafter referred to as tanks, wherein each tank is crimped to a corresponding header for configuring a sealed connection there between and forming a header-tank assembly. The tanks are capable of receiving heat exchanging fluid, often pressurized heat exchanging fluid at regular time intervals and as such are subjected to cyclic loading. The tank is generally of reinforced plastic material, particularly, PA 66, GF 30-40. In absence of any pressure relief features, the cyclic loads acting on the tank may cause side walls of the tank to budge outward resulting in failures, such as for example, lateral un-crimping between the tank and the corresponding header and formation of groove cracks on the header. Such failures may cause leakage of heat exchange fluid from the tank, such as for example, glycol in case the heat exchanger is a radiator and refrigerant in case the heat exchanger is an evaporator or a condenser. The continuous leakage of the heat exchange fluid from the tank may result in problems such as pressure loss inside the tank, the tank requiring frequent refilling and inefficient operation of the heat exchanger due to insufficient heat exchange fluid. In case leakage of the heat exchange fluid is left unattended and unchecked, the level of heat exchange fluid may drop below critical levels that may in turn cause complications such as complete breakdown of associated critical elements that may fail due to non-performance of the heat exchanger. For example, in case the heat exchanger is a radiator, the dropping of heat exchange fluid levels below critical level may render the radiator inefficient in removing heat from the engine, thereby resulting in engine seizure due to excessive heat. As the tank is crimped to the corresponding header that in turn is integrally formed on either one of the end portions of a heat exchanger core, structural failure of the tank may cause replacement of the entire heat exchanger instead of replacement of the tank alone. As such failure of the tank is critical issue and high expenses are involved in addressing tank failures.

In order to prevent failure of the tank, generally, structural changes are incorporated in the tank structure for providing reinforcement to the tank structure and improving mechanical strength and rigidity of the tank structure. Such structural changes include increasing thickness of the tank, increasing thickness of the header and forming ribs on the tank. Various complicated configurations of the ribs that can be formed on the tank, for reinforcing the tank are proposed. However, as the tank along with the ribs integrally formed thereon are simultaneously formed by molding process in a single step, configuring such ribs on the tank renders the manufacturing of such tank complex. Further, configuring internal rod or plate for connecting side walls of the tank for holding together the side walls of the tank and preventing outward bulging of the side walls of the tank is also suggested, however, such arrangement gives rise to stress concentration and problems associated with formation of weld lines. Also, usage of internal rod is not feasible and also not recommended considering packaging constrains associated with packaging of the internal elements inside the tank. Further, such configuration of the internal rod connecting side walls of the tank may cause pressure drop inside the tank. Still further, the internal rod occupies space within the tank and prevents implementation of auxiliary elements such as oil coolers within the tank. Accordingly, there is a need for a tank configured with an external reinforcement system that enables the tank to withstand cyclic pressures acting on the internal walls of the tank and that prevents failure of the tank and other problems arising due to outward bulging of the side walls of the tank.

SUMMARY OF DISCLOSURE

An object of the present invention is to provide a heat exchange tank configured with a reinforcement system that provides mechanical strength and rigidity to the heat exchanger tank structure, while still obviating drawbacks associated with conventional reinforcement systems.

Another object of the present invention is to provide a heat exchange tank that is capable of withstanding cyclic pressures acting on internal walls thereof.

Another object of the present invention is to provide a heat exchange tank configured with a reinforcement system that prevents outward bulging of side walls of the heat exchanger tank, thereby preventing failures such as for example, lateral un-crimping between the heat exchanger tank and a corresponding header and formation of groove cracks on the header.

Still another object of the present invention is to provide a heat exchange tank configured with a reinforcement system that is externally configured on the tank structure for reinforcing the tank structure and that prevents drawbacks associated with internal reinforcement system such as internal rod that may cause pressure drop within the tank and prevent implementation of auxiliary elements such as oil coolers within the tank.

Still another object of the present invention is to provide a heat exchanger tank configured with a reinforcement system that is simple in construction and use.

Yet another object of the present invention is to provide a heat exchanger tank that is reliable and inexpensive.

Another object of the present invention is to provide heat exchanger tank configured with a reinforcement system that is adjustable to provide reinforcement to any section of the tank structure as per requirement.

Still another object of the present invention is to provide heat exchanger tank configured with a reinforcement system for reinforcing the tank structure and preventing structural failures in the tank, thereby eliminating leakage of heat exchange fluid from the tank caused due to structural failures.

Another object of the present invention is to provide a heat exchange tank that exhibits extended service life, efficient operation and that involves lesser maintenance.

In the present description, some elements or parameters may be indexed, such as a first element and a second element. In this case, unless stated otherwise, this indexation is only meant to differentiate and name elements which are similar but not identical. No idea of priority should be inferred from such indexation, as these terms may be switched without betraying the invention. Additionally, this indexation does not imply any order in mounting or use of the elements of the invention.

A Heat exchanger tank is disclosed in accordance with an embodiment of the present invention. The heat exchanger tank includes external ribs that provide reinforcement to structure of the tank. At least one reinforcement element engages with an external tank portion and gets tensioned by press fitting the at least one reinforcement element on said external tank portion such that limbs of the reinforcement element are separated by the external tank portion between the external ribs. The reinforcement element is further maintained in the tensioned configuration by using at least one retention means.

In accordance with an embodiment of the invention, the retention means includes at least one first latching elements configured on the limbs of the reinforcement element that engage with corresponding at least one second latching elements configured on the external tank portion.

Specifically, the first latching elements and the second latching elements configure releasable engagement therebetween.

In accordance with another embodiment of the invention, the first latching elements are apertures formed on the limbs of the reinforcement element that configure snap fit engagement with corresponding second latching elements in form of tongue elements formed on the external tank portion.

Alternatively, the first latching elements are tongue elements formed on the limbs of the reinforcement element that configure snap fit engagement with corresponding second latching elements in form of apertures formed on the external tank portion.

Generally, the at least one first latching element is configured near end portion of each limb of the reinforcement element.

Preferably, in a disengaged configuration of the reinforcement element with respect to the tank and free-state thereof, the spacing between the limbs of each of the reinforcement element is smaller than width of the tank.

Generally, the reinforcement element is of a material exhibiting spring properties and is selected from a group comprising of metals, plastics and composites.

Specifically, at least two external ribs configured on the tank define a channel extending along outer periphery of the external tank portion, wherein the channel is configured to guide the reinforcement element on the external tank portion at least until the first latching elements configured on the reinforcement element engages with the second latching elements provided on either one of the external tank portion and the ribs defining the channel.

A heat exchanger is disclosed in accordance with an embodiment of the present invention, the heat exchanger includes a pair of spaced apart headers connected by a plurality of heat exchange elements and a pair of tanks, wherein each tank is crimped to a corresponding header and receives heat exchanging fluid, wherein at least one tank of the pair of tanks is according to one of the tank above disclosed.

In accordance with an embodiment of the present invention, each header of the pair of headers is configured to receive the corresponding tank of the pair of tanks within a peripheral groove thereof, wherein the end portion of each limb of the reinforcement element covers at least a part of the peripheral groove of the header.

In accordance with an embodiment, end portion of each limb of the reinforcement element covers at least a part of the header, notably at least a part of a corresponding crimped profile of the header formed by crimping between the header and the corresponding tank.

Further, the retention means includes attaching elements configured at end portion of each limb of the reinforcement element that are crimped over at least a part of the header, notably at least a part of the corresponding crimped profile of the header formed by crimping between the header and the corresponding tank.

Still further, the retention means includes at least one latching element in form of end portions of the limbs that engage with corresponding at least one latching elements in form of at least a portion of crimped profile configured on the corresponding header.

Other characteristics, details and advantages of the invention can be inferred from the description of the invention hereunder. A more complete appreciation of the invention and many of the attendant advantages thereof will be readily obtained as the same becomes better understood by reference to the following detailed description when considered in connection with the accompanying figures, wherein:

It must be noted that the figures disclose the invention in a detailed enough way to be implemented, said figures helping to better define the invention if needs be. The invention should however not be limited to the embodiment disclosed in the description.

DETAILED DESCRIPTION

A heat exchanger tank configured with reinforcement elements for strengthening and reinforcing the tank structure is disclosed in accordance with an embodiment of the present disclosure. Although, as per the disclosures made in the present specification, the heat exchanger tank is used in vehicle heat exchangers such as radiators, condensers, evaporators and charger air coolers. However, the tank of the present invention is also applicable for use in other systems and is not limited for use in vehicle heat exchangers only. Particularly, such tanks are also applicable in any other systems or applications in which the tank is required to hold liquid and withstand cyclic pressures.

Figure 1A:
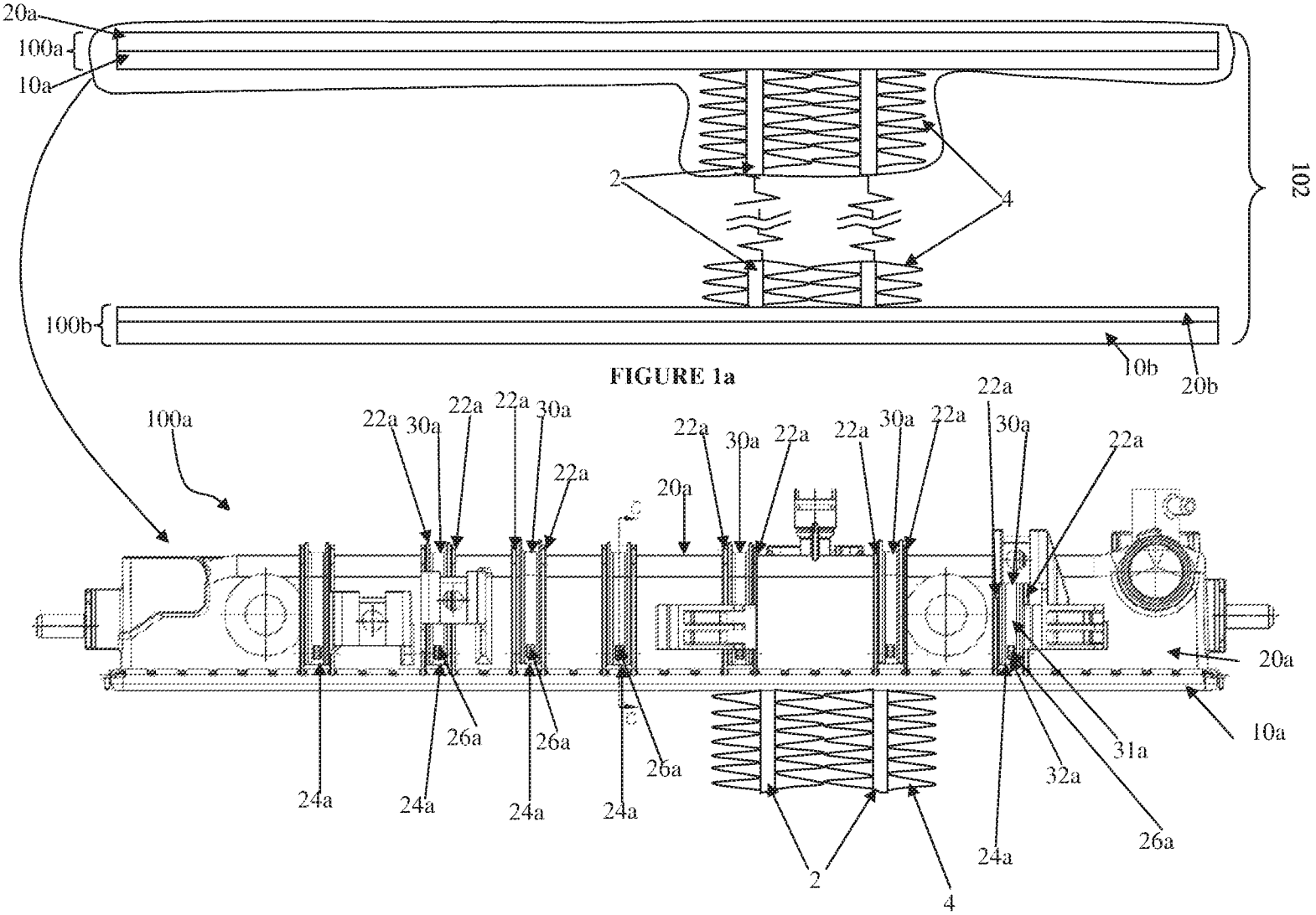
FIG. 1*a* illustrates a schematic representation of a heat exchanger with a heat exchanger tank in accordance with an embodiment of the present invention crimped to a corresponding header for configuring a header-tank assembly, also is illustrated an enlarged view of the heat exchanger tank with reinforcement elements engaging with external tank portions for providing reinforcement to the tank.

Referring to FIG. 1*a*, a heat exchanger 102 is illustrated. The heat exchanger 102 generally includes a pair of identical header-tank assemblies 100*a* and 100*b* (or at least very similar header-tank assemblies), wherein each header-tank assembly of the pair is configured at extreme end portion of a heat exchanger core. Particularly, a first header 10*a* and a second header 10*b* of the first and the second header-tank assemblies 100*a* and 100*b* are integrally formed on respective first and second extreme end portions of the heat exchanger core. The heat exchanger core is configured of a plurality of heat exchange elements 2 (partially illustrated on FIG. 1*a*) and a plurality of fin elements 4 (also partially illustrated on FIG. 1*s*) formed on the heat exchanger elements 2. The heat exchange elements 2 may be either one of plates and tubes. Alternatively, the heat exchange elements 2 can have any other configuration that forms connection between the first header 10*a* and the second header 10*b* and configures adjacent yet separated spaces between the first and the second headers 10*a* and 10*b* for facilitating heat exchange between heat exchanging fluids flowing through the respective separated spaces and the heat exchanger elements. The heat exchanger further includes a pair of tanks 20*a* and 20*b* securely connected to the corresponding headers 10*a* and 10*b* by crimping for configuring the respective first and the second header-tank assemblies 100*a* and 100*b*. The tanks 20*a* and 20*b* receive heat exchanging fluid, often pressurized heat exchanging fluid at regular time intervals and holds the heat exchanging fluid therein.

Figure 1B:
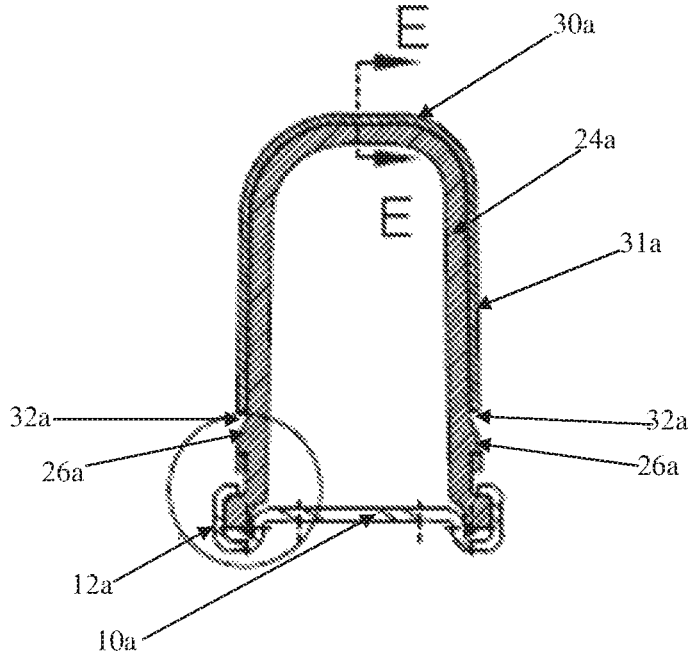
FIG. 1*b* illustrates a cross sectional view of the header-tank assembly along section line C-C depicted in FIG. 1*a;*
Figure 1C:
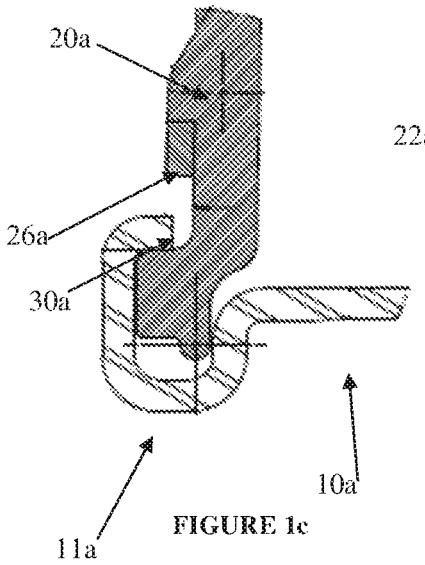
FIG. 1*c* illustrates an enlarged cross sectional view depicting a foot portion of the heat exchanger tank received within a peripheral groove of the header of the header-tank assembly of FIG. 1*b;*

Again referring to FIG. 1*a*, as the first and the second header-tank assemblies 100*a* and 100*b* are commonly identical (or quite similar), every embodiment disclosed henceforth for the header-tank assembly 100*a* and the elements configuring the header-tank assembly 100*a* may also be applicable for the header-tank assembly 100*b* and elements configuring the header-tank assembly 100*b*, for sake of brevity of present document, enlarged view depicting the details of only the first header-tank assembly 100*a* is illustrated in the Figures and described in the description. The first header-tank assembly 100*a* is configured at the first end portion of the heat exchanger core. Particularly, the first header 10*a* of the first header-tank assembly 100*a* is integrally formed on the end portion of the heat exchanger core and is crimped to the corresponding tank 20*a*. Generally, the header 10*a* includes a peripheral groove 11*a* that is configured to receive a foot portion of the corresponding tank 20*a* as illustrated in FIG. 1*b* and FIG. 1*c*. In accordance with an embodiment, a gasket (not illustrated in drawings) is disposed between the foot portion of the tank 20*a* and the inside walls of the header 10*a* defining the peripheral groove 11*a*, as the header 10*a* is crimped with the corresponding tank 20*a* for configuring sealing engagement there between. The gasket prevents leakage of the heat exchange fluid through the crimped portion configured by crimping between the header 10*a* and the tank 20*a*. In accordance with an embodiment, the gasket is of either one of synthetic polymeric material and natural polymeric material, such as for example rubber.

In accordance with an embodiment, the tank 20*a* includes a plurality of external ribs 22*a* configured on an outside surface of the tank 20*a* to provide reinforcement to structure of the tank 20*a*. In accordance with an embodiment, at least one reinforcement element 30*a* is engaged with an external tank portion and tensioned by press fitting the at least one reinforcement element 30*a* on the external tank portion such that limbs 31*a* of the reinforcement element 30*a* are separated by the external tank portion between the external ribs 22*a*. The reinforcement elements 30*a* are maintained in the tensioned configuration by using at least one retention means.

Figure 1D:
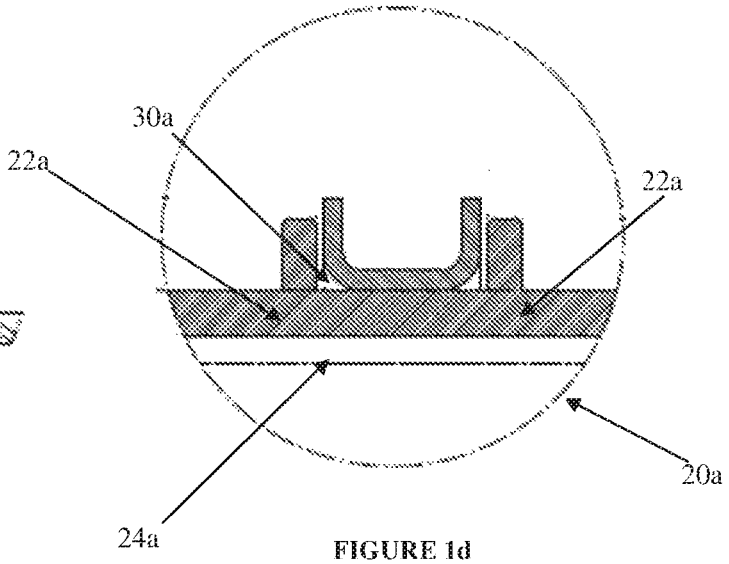
FIG. 1*d* illustrates a cross sectional view of the header-tank assembly along section line E-E depicted in FIG. 1*b;*

In accordance with a preferred embodiment, at least two external ribs 22*a* configured on the tank 20*a* define at least one channel 24*a* extending along an outer periphery of the external tank portion. Particularly, the adjacent external ribs 22*a* along with the external tank portion between the adjacent external ribs 22*a* configure the corresponding channel 24*a*. Referring to the FIG. 1*d*, the internal profile of each of the reinforcement element 30*a* is complementary to an external profile of the tank portion between the adjacent external ribs 22*a*. The reinforcement element 30*a* is tensioned, as the reinforcement element 30*a* is press fitted in the corresponding channel 24*a*. The reinforcement element 30*a* in the tensioned configuration received in the corresponding channel 24*a* facilitate in providing reinforcement to the tank 20*a* by pressing the side walls of the tank 20*a* inward. Also, as the reinforcement element 30*a* is detactably received in the corresponding channel 24*a*, the reinforcement element 30*a* can be shifted from one channel to another channel along the length of the tank 20*a*. Such configuration provides flexibility to reinforce any section of the tank 20*a* as per requirement. Each of the channel 24*a* is configured to guide the reinforcement element 30*a* on the external tank portion at least until at one first latching element 32*a* configured on the reinforcement element 30*a* engages with at least one second latching element 26*a* configured on external tank portion within the channel 24*a* in order to maintain the reinforcement element 30*a* in tensioned configuration. In accordance with an embodiment of the present invention, the external ribs 22*a* are parallel to each other and the number and spacing between the ribs 22*a* configured on the tank 20*a* is based on number and placement of the channels 24*a* to be configured on the tank 20*a* and width of reinforcement elements 30*a* to be received in the corresponding channel 24*a*. In accordance with an embodiment, the ribs 22*a* are integral with the tank 20*a* and are simultaneously formed along with the tank 20*a* by molding process. However, the present invention is not limited to any particular configuration of the external ribs 22*a* and any particular method for configuring the external ribs 22*a* on the tank 20*a*, as far as the external ribs 22*a* provide reinforcement to structure of the tank 20*a* and also configure the channels 24*a* extending along outer periphery of the tank 20*a* for receiving the reinforcement element 30*a* in tensioned configuration over the external tank portion. The reinforcement element 30*a* externally snap-on fits and clips on to the tank 20*a* as illustrated in FIG. 1*b* to provide reinforcement to the tank structure.

Figure 2A:
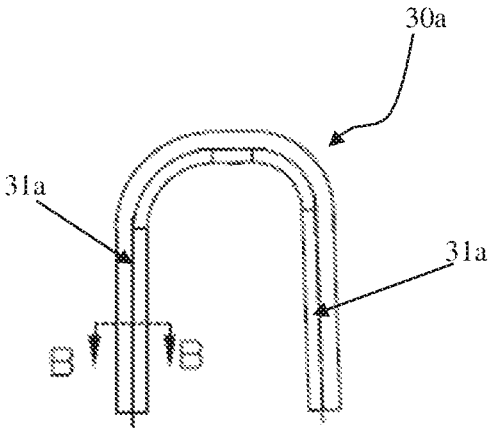
FIG. 2*a* illustrates a schematic representation depicting a front view of the reinforcement element of FIG. 1*a;*
Figure 2B:
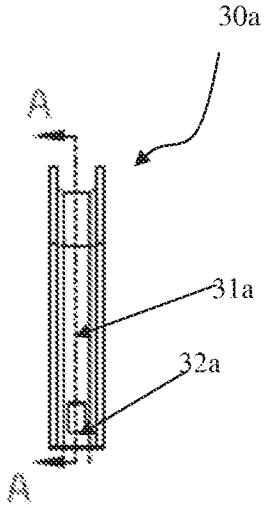
FIG. 2*b* illustrates a schematic representation depicting a right hand side view of the reinforcement element of FIG. 2*a;*
Figure 2C:
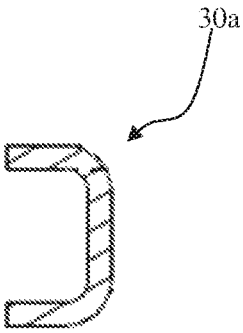
FIG. 2*c* illustrates a cross sectional view of the reinforcement element along section line B-B depicted in FIG. 2*a;*
Figure 2D:
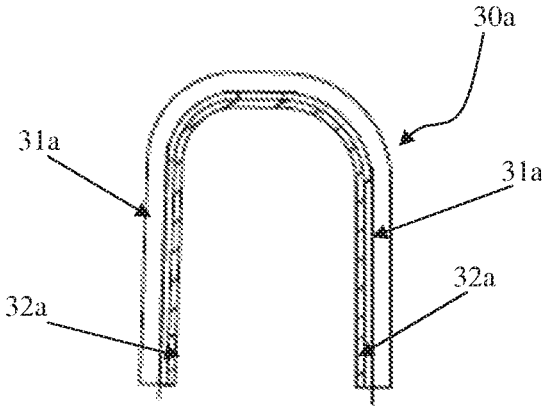
FIG. 2*d* illustrates a cross sectional view of the reinforcement element along section line A-A depicted in FIG. 2*b;*

FIG. 2*a* illustrates a schematic representation depicting a front view of the reinforcement element 30*a*. The reinforcement element 30*a* is generally having an U-shaped profile, includes a pair of limbs 31*a* and at least one first latching element 32*a* configured on each limb 31*a*. FIG. 2*b* illustrates a schematic representation depicting a right hand side view of the reinforcement element 30*a* with the first latching element 32*a* formed on the right hand side limb 31*a*. FIG. 2*c* illustrates a cross sectional view of the reinforcement element 30*a* along section line B-B depicted in FIG. 2*a*. FIG. 2*d* illustrates a cross sectional view of the reinforcement element 30*a* along section line A-A depicted in FIG. 2*b*. The reinforcement element 30*a* is so configured that when the reinforcement element 30*a* is in free-state and disengaged from the tank 20*a*, the spacing between the limbs 31*a* of each of the reinforcement element 30*a* is lesser/smaller than width of the tank portion between the external ribs 22*a* defining the corresponding channel 24*a*. Also, the reinforcement element 30*a* is of material exhibiting spring properties and is selected from group comprising of metals, plastics and composites. Due to such configuration, the reinforcement element 30*a* is subjected to elastic deformation as the reinforcement element is press fitted on the tank to cause tensioning in the reinforcement element 30*a*. As such, the reinforcement element 30*a* is in the tensioned configuration when the reinforcement element 30*a* is received in the corresponding channel 24*a*. However, the present invention is not limited to any particular material and configuration of the reinforcement element 30*a*, as far as the reinforcement element 30*a* is elastically deformable to attain tensioned configuration as the reinforcement element 30*a* is received over the tank portion between the ribs 22*a* defining the corresponding channel 24*a*.

As the at least one reinforcement element 30*a* is tensioned by press fitting the at least one reinforcement element 30*a* on the tank portion between the ribs 22*a* defining the corresponding channel 24*a*, the limbs 31*a* of the reinforcement element 30*a* are pulled away from each other and separated by the tank portion. Further, in the tensioned configuration of the reinforcement element 30*a*, the limbs 31*a* thereof receive the tank portion that is wider than space between the limbs 31*a* of the reinforcement element 30*a* in free-state thereof, thereby causing the limbs 31*a* to deform elastically to receive the tank portion and inwardly press the tank portion received there-between. Particularly, in the tensioned configuration of the reinforcement element 30*a*, the limbs 31*a* of the reinforcement element 30*a* press the side walls of the tank portion between the adjacent external ribs 22*a* inwardly to prevent bulging out of the side walls of the tank 20*a*.

Similarly, other reinforcement elements 30*a* are also tensioned by press fitting the reinforcement elements 30*a* on the corresponding channels 24*a* configured at regular space intervals on the tank 20*a*, thereby reinforcing the tank 20*a* throughout the length of the tank 20*a* and preventing outward bulging of the sidewalls of the tank 20*a*, even when cyclic pressures are acting on internal walls of the tank 20*a*. The reinforcement of the tank 20*a* in this manner prevents outward bulging of the side walls of the tank 20*a* and failures resulting from outward bulging of side walls of the tank 20*a*, such as for example, lateral un-crimping between the tank 20*a* and the corresponding header 10*a* and formation of groove cracks on the header 10*a*.

The reinforcement element 30*a*, 130*a*, 230*a* is maintained in the tensioned configuration by using at least one retention means. The retention means may include at least one first latching element 32*a* configured on each of the limbs 31*a* of the reinforcement element 30*a* and at least one second latching element 26*a* complimentary to the first latching element 32*a*. The at least one second latching element 26*a* is configured on the corresponding tank portion disposed on each side of the tank 20*a* and defined by the ribs 22*a*, particularly, corresponding channel portion receiving the limbs 31*a* of the reinforcement element 30*a*. The retention means may further include, attaching means 234*a* in the form of u-clips configured at extreme ends of the limbs 231*a* of the reinforcement element 230*a*, in accordance with an embodiment of the present invention. However, the present invention is not limited to any particular number, placement and configuration of the first latching elements 32*a*, 132*a*, 232*a*, the second latching elements 26*a* and the attaching means 234*a* as far as these are capable of configuring engagement between the reinforcement element 30*a*, 130*a*, 230*a* in tensioned configuration and the corresponding tank portion, particularly, the channel 24*a* for maintaining the reinforcement element 30*a*, 130*a*, 230*a* in tensioned configuration as the reinforcement element is received in the corresponding channel 24*a*.

Figure 3A:
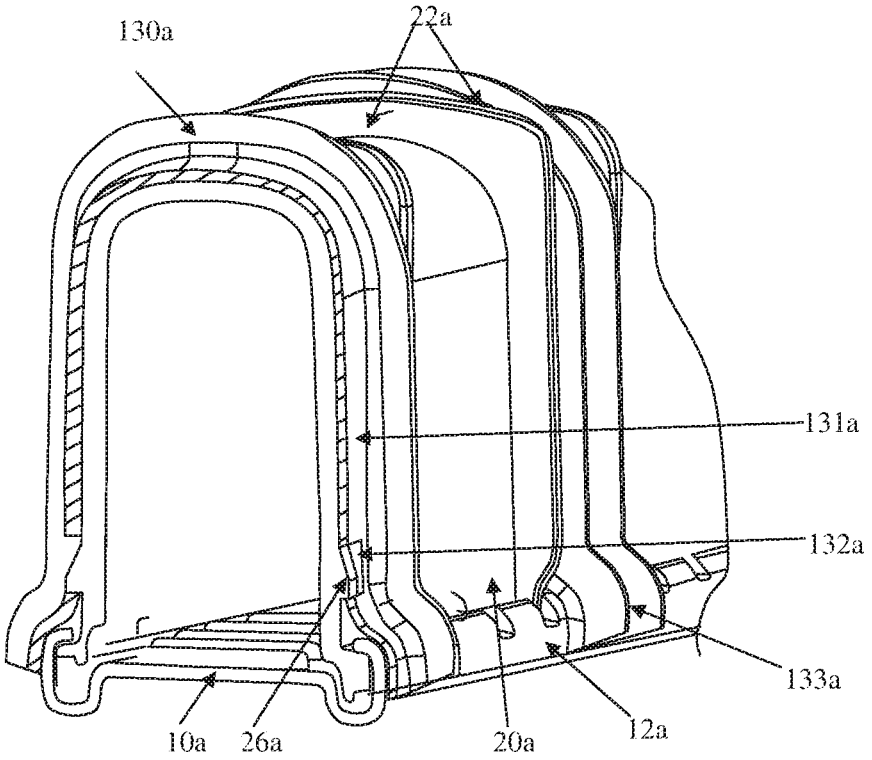
FIG. 3*a* illustrates a schematic representation of the tank configured with reinforcement element in accordance with another embodiment of the present invention, wherein extreme end portion of each limb of the reinforcement element is covering at least a portion of a corresponding crimped profile formed by crimping between the header and the corresponding tank.
Figure 3B:
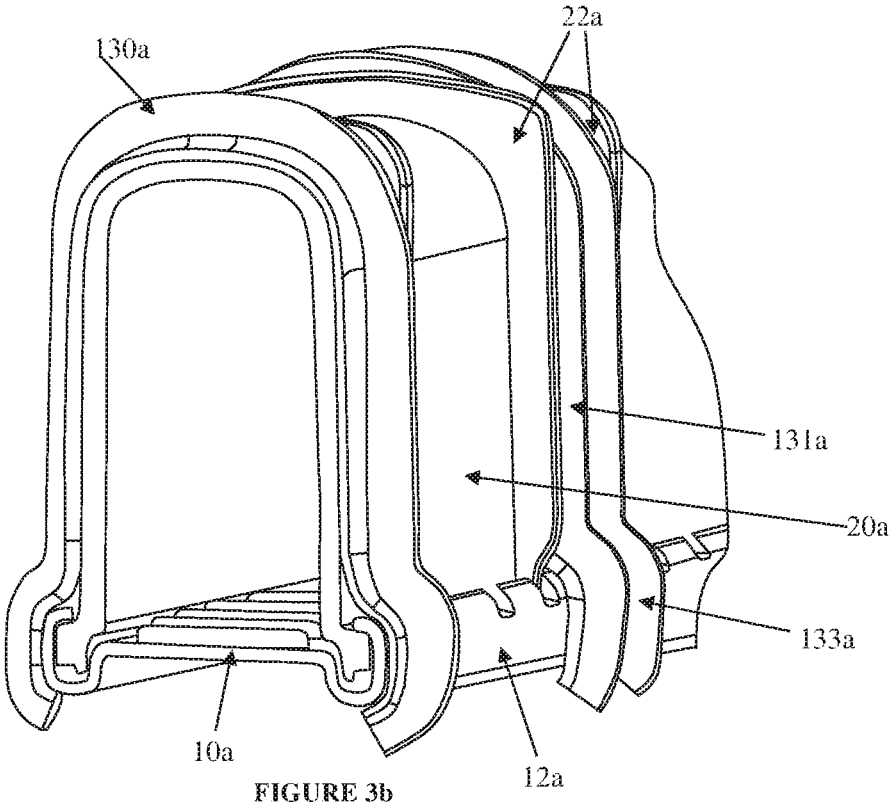
FIG. 3*b* illustrates a schematic representation depicting the tank configured with the reinforcement element of FIG. 3*a*, wherein extreme end portion of each limb of the reinforcement element is substantially covering the corresponding crimped profile formed by crimping between the header and the corresponding tank.

FIG. 3*a* illustrates an isometric view depicting the tank 20*a* configured with a reinforcement element 130*a*, in accordance with another embodiment of the present invention is illustrated, wherein first and second latching elements 132*a* and 26*a* are depicted in engaged configuration with each other and an extreme end portion 133*a* of each limb 131*a* of the reinforcement element 130*a* is covering at least a portion of a corresponding crimped profile 12*a* formed by crimping between the header 10*a* and the corresponding tank 20*a*. FIG. 3*b* illustrates a schematic representation depicting the tank 20*a* configured with the reinforcement element 130*a*, wherein the extreme end portion 133*a* of each limb 131*a* of the reinforcement element 130*a* is substantially covering the corresponding crimped profile 12*a* formed by crimping between the header 10*a* and the corresponding tank 20*a*.

Again referring to FIG. 3*a* and FIG. 3*b*, the reinforcement element 130*a* is tensioned when the reinforcement element 130*a* is received over the corresponding tank portion, particularly, the channel 24*a* defined by the ribs 22*a* by press fitting the reinforcement element 30*a* on the corresponding channel 24*a*. The reinforcement element 30*a* is maintained in the tensioned configuration in the corresponding tank portion, particularly, the channel 24*a* by the retention means in form of the first and second latching elements. Particularly, the first and the second latching elements are complimentary to each other, such that the at least one first latching element 132*a*, in form of aperture configured on the limbs 131*a* of the reinforcement element 130*a* engage with the corresponding second latching element 26*a*, in form of a tongue element configured on corresponding tank portions, particularly, channel portions disposed on each side of the tank 20*a* to facilitate maintaining the reinforcement element 30*a* in the tensioned configuration. In accordance with another embodiment, the first latching elements 132*a*, in form of tongue elements formed on the limbs 131*a* of the reinforcement element 130*a* configure snap fit engagement with corresponding second latching elements in form of apertures formed on corresponding channel portions disposed on each side of the tank 20*a* to facilitate in maintaining the reinforcement element 130*a* in the tensioned configuration. In accordance with an embodiment, the at least one first latching element 132*a* is configured near end portion of each limb 131*a* of the reinforcement element 130*a*. In accordance with an embodiment, the at least one second latching element 26*a* is configured on the corresponding tank portion, particularly, the channel 24*a*. In accordance with another embodiment, the at least one second latching element 26*a* is configured on the ribs 22*a* defining the channel 24*a* and is configured so as to engage with corresponding first latching element 132*a* configured near end portion of each limb 131*a* to facilitate maintaining the reinforcement element 130*a* in the tensioned configuration. Further, the end portion 133*a* of the limbs 131*a* latch/engage with the crimped profile 12*a* of the header 10*a*. With such configuration two point latching is achieved, wherein first latching is achieved between first latching element 132*a* and second latching element 26*a*, whereas the second latching is achieved between end portion 133*a* of limbs 131*a* and the crimped profile 12*a* of the header 10*a*. The end portion 133*a* of limbs 131*a* engaging with at least a portion of the crimped profile 12*a* redundantly maintains the reinforcement element 130*a* in tensioned configuration over the corresponding tank portion, particularly, the channel 24*a*. Such configuration prevents unintentional or accidental disengagement between the first latching elements 132*a* and the second latching element 26*a* and maintains the connection between the reinforcement element 130*a* and the corresponding tank portion, particularly, the channel 24*a*, thereby, facilitating in maintaining the reinforcement element 130*a* in the tensioned configuration over the corresponding tank portion, particularly, the channel 24*a*. However, the present invention is not limited to any particular configuration and placement of the latching elements as far as the latching elements engage with each other to facilitate in maintaining the reinforcement element 130*a* in the tensioned configuration. In accordance with an embodiment, the heat exchanger further includes a resilient material disposed between the at least one limb 131*a* of the reinforcement element 130*a* and corresponding tank portion, particularly, channel portion between the adjacent external ribs 22*a* defining the corresponding channel 24*a*. Such configuration further facilitates in maintaining the reinforcement element 130*a* in the tensioned configuration and prompts the limbs 131*a* of the reinforcement element 130*a* to further press the side walls of the tank 20*a* inwardly.

Figure 4A:
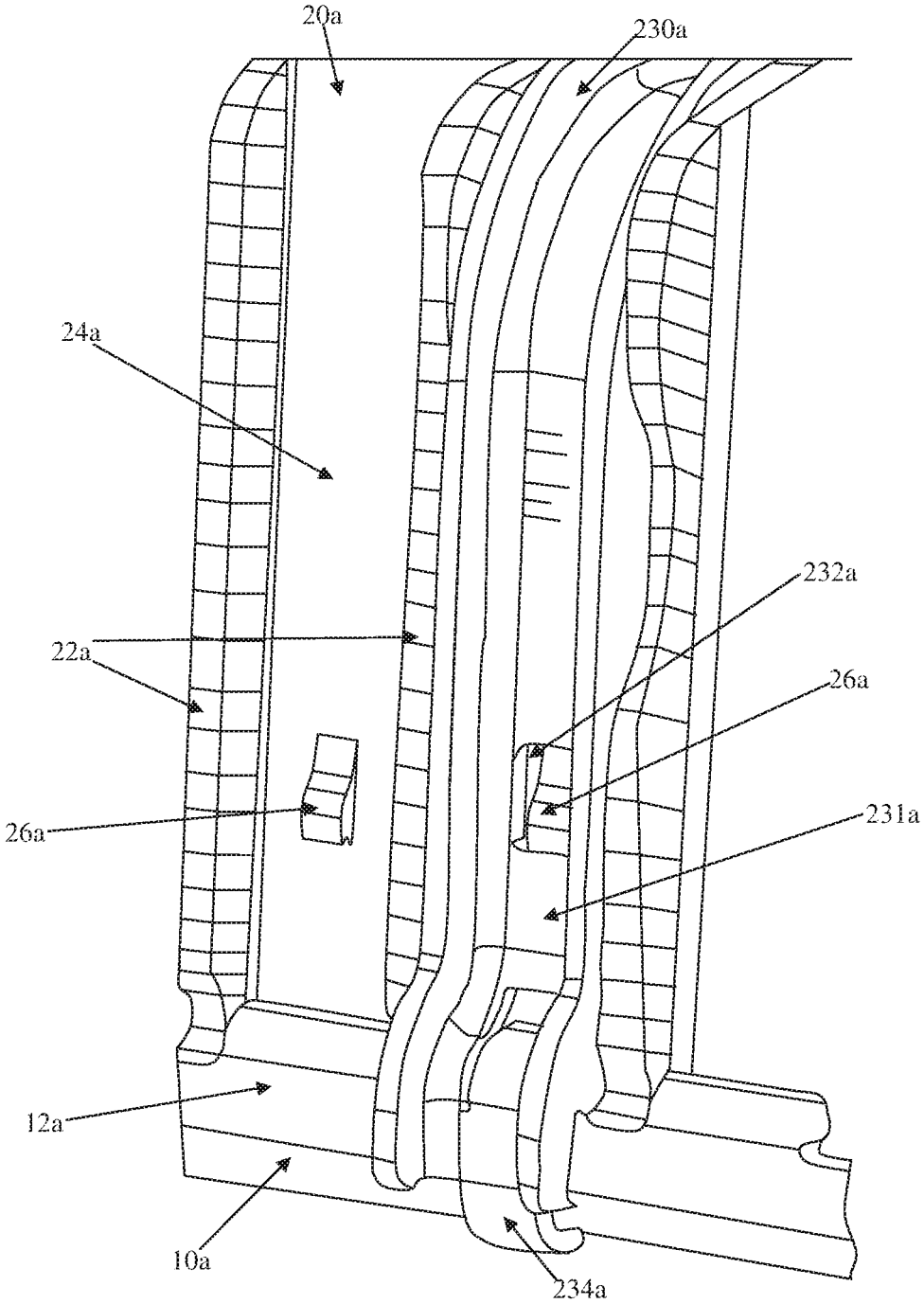
FIG. 4*a* illustrates an isometric view depicting a reinforcement element in accordance with another embodiment of the present invention, wherein an attaching element configured at end portion of each limb of the reinforcement element is crimped over at least a part of a corresponding crimped profile formed by crimping between a header and a corresponding tank.
Figure 4B:
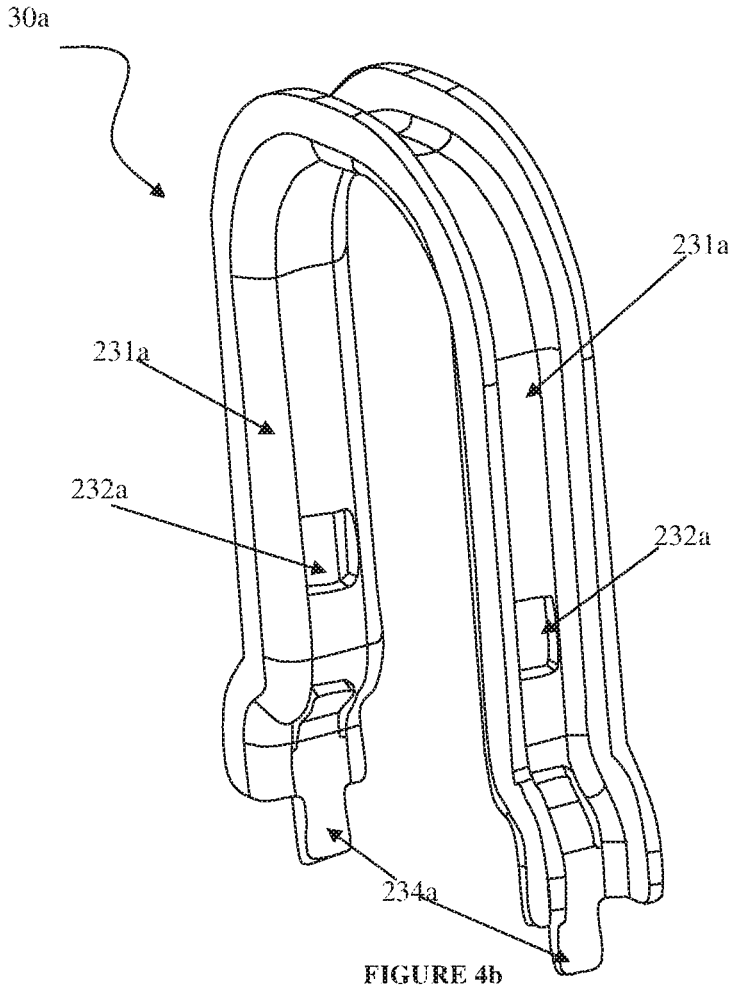
FIG. 4*b* illustrates an isometric view of the reinforcement element of FIG. 4*a*, wherein the attaching elements in form of u-clips are depicted in un-crimped configuration.
Figure 4C:
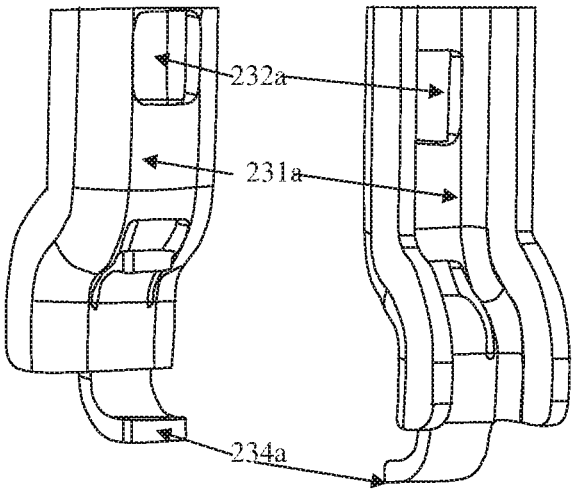
FIG. 4*c* illustrates an isometric view of the reinforcement element of FIG. 4*a*, wherein the attaching elements in form of u-clips are depicted in crimped configuration, however, for better understanding and visualization of attaching elements in the crimped configuration, the attaching elements are only depicted without depicting the tank and the header.

In accordance with another embodiment illustrated in FIG. 4*a*, apart from engagement between at least one first latching element 232*a* and at least one second latching element 26*a*, an attaching element 234*a* in the form of u-clips configured at an extreme end of each limb 231*a* of the reinforcement element 230*a* get crimped over at least a portion of the crimped profile 12*a* formed by crimping between the header 10*a* and the corresponding tank 20*a* to facilitate maintaining the reinforcement element 230*a* in the tensioned configuration. FIG. 4*a* illustrates an isometric view of the reinforcement element 230*a* depicting the attaching element 234*a* crimped over at least a part of a corresponding crimped profile 12*a* formed by crimping between the header 10*a* and the corresponding tank 20*a*. FIG. 4*b* and FIG. 4*c* illustrate the attaching element 234*a* in the form of u-clips in un-crimped and crimped configurations respectively, specifically, for the sake of clearly depicting the different configurations of the u-clips, the FIG. 4*b* and FIG. 4*c* depict only the u-clips without depicting the tank 20*a* and the header 10*a*.

More specifically, the crimping of the u-clips over at least a portion of the crimped profile 12*a* redundantly maintains the reinforcement element 230*a* in tensioned configuration over the corresponding tank portion, particularly, the channel 24*a*. Such configuration prevents unintentional or accidental disengagement between the first latching elements 232*a* and the second latching element 26*a* and maintains the connection between the reinforcement element 230*a* and the corresponding tank portion, particularly, the channel 24*a*, thereby, facilitating in maintaining the reinforcement element 230*a* in the tensioned configuration over the corresponding tank portion, particularly, the channel 24*a*. The engagement between the first latching elements 232*a* and the second latching elements 26*a*, further facilitates in locating and maintaining the reinforcement element 230*a* in desired position within the corresponding tank portion, particularly, the channel 24*a* as the u-clips configured at ends of the limbs 231*a* of the reinforcement element 230*a* are crimped being over at least a portion of the crimped profile 12*a*.

A similar header-tank assembly 100*b*, referred to as the second header tank assembly 100*b* is configured at opposite end portion of the heat exchanger core, wherein the second header 10*b* is crimped on the corresponding tank 20*b*. Also, similar reinforcement elements 30*b* in the tensioned configuration are detactably received in corresponding channels 24*b* configured on the tank 20*b* for providing reinforcement to the tank 20*b*. The details regarding the manner in which the reinforcement elements 30*b* are tensioned by press fitting the reinforcement elements 30*b* in the channels 24*b* and maintaining the reinforcement elements 30*b* in tensioned configuration by retention means is similar to the manner in which the reinforcement elements 30*a* are tensioned and maintained in the tensioned configuration by the retention means and as such are not elaborately disclosed in the present document for the sake of brevity of the present document.

Several modifications and improvement might be applied by the person skilled in the art to the heat exchanger tank as defined above, as long as it comprises external ribs that provide reinforcement to structure of the tank, wherein at least one reinforcement element engages with an external tank portion and is tensioned by press fitting the at least one reinforcement element on the external tank portion such that limbs of the reinforcement element are separated by the external tank portion between the external ribs. The reinforcement element is further maintained in the tensioned configuration by using at least one retention means.

Obviously, numerous modifications and variations of the present invention are possible in light of the above teachings. It is therefore to be understood that the invention may be practiced otherwise than as specifically described herein.

In any case, the invention cannot and should not be limited to the embodiments specifically described in this document, as other embodiments might exist. The invention shall spread to any equivalent means and any technically operating combination of means.

The invention claimed is:

1. A heat exchanger tank comprising:

external ribs adapted to provide reinforcement to a structure of the heat exchanger tank, wherein the external ribs are provided on an outer surface of the structure of the heat exchanger tank from one side of the heat exchanger tank to an opposite side of the heat exchanger tank, wherein at least one reinforcement element is configured to be engaged with an external tank portion and tensioned by press fitting the at least one reinforcement element on the external tank portion such that limbs of the at least one reinforcement element are separated by the external tank portion between the external ribs, wherein an internal profile of the at least one reinforcement element is complementary to an external profile of the external tank portion such that the at least one reinforcement element is provided on the outer surface of the structure of the heat exchanger tank from the one side of the heat exchanger tank to the opposite side of the heat exchanger tank, and wherein the at least one reinforcement element is maintained in a tensioned configuration by using at least one retention means.

2. The heat exchanger tank as claimed in claim 1, wherein the at least one retention means comprises at least one first latching element configured on the limbs of the at least one reinforcement element that are adapted to engage with at least one corresponding second latching element configured on the external tank portion.

3. The heat exchanger tank as claimed in claim 2, wherein the at least one first latching element and the at least one corresponding second latching element are adapted to configure releasable engagement there-between.

4. The heat exchanger tank as claimed in claim 3, wherein the at least one first latching element is apertures formed on the limbs of the at least one reinforcement element that are adapted to configure snap fit engagement with the at least one corresponding second latching element in form of tongue elements formed on the external tank portion.

5. The heat exchanger tank as claimed in claim 3, wherein the at least one first latching element is tongue elements formed on the limbs of the at least one reinforcement element that are adapted to configure snap fit engagement with the at least one corresponding second latching element in form of apertures formed on the external tank portion.

6. The heat exchanger tank as claimed in claim 2, wherein the at least one first latching element is configured near an end portion of each limb of the at least one reinforcement element.

7. The heat exchanger tank as claimed in claim 2, wherein at least two external ribs of the external ribs configured on the heat exchanger tank define a channel extending along outer periphery of the external tank portion, wherein the channel is configured to guide the at least one reinforcement element on the external tank portion at least until the at least one first latching element configured on the at least one reinforcement element engages with the at least one corresponding second latching element provided on either one of the external tank portion or the at least two external ribs defining the channel.

8. The heat exchanger tank as claimed in claim 1, wherein in a disengaged configuration of the at least one reinforcement element with respect to the heat exchanger tank and free-state thereof, spacing between the limbs of the at least one reinforcement element is smaller than a width of the heat exchanger tank.

9. The heat exchanger tank as claimed in claim 1, wherein the at least one reinforcement element is of a material exhibiting spring properties and is selected from a group consisting of metals, plastics and composites.

10. The heat exchanger tank as claimed in claim 1, wherein the wherein at least one reinforcement element is a plurality of reinforcement elements, wherein each reinforcement element is arranged between pairs of the external ribs.

11. A heat exchanger comprising:

a pair of spaced apart headers connected by a plurality of heat exchange elements; and a pair of tanks, wherein each tank is crimped to a corresponding header of the pair of spaced apart headers and is adapted to receive heat exchanging fluid, wherein at least one tank of the pair of tanks comprises:

external ribs adapted to provide reinforcement to a structure of the at least one tank, wherein the external ribs are provided on an outer surface of the structure of the at least one tank from one side of the at least one tank to an opposite side of the at least one tank, wherein at least one reinforcement element is configured to be engaged with an external tank portion and tensioned by press fitting the at least one reinforcement element on the external tank portion such that limbs of the at least one reinforcement element are separated by the external tank portion between the external ribs, wherein an internal profile of the at least one reinforcement element is complementary to an external profile of the external tank portion such that the at least one reinforcement element is provided on the outer surface of the structure of the heat exchanger tank from the one side of the heat exchanger tank to the opposite side of the heat exchanger tank, wherein the at least one reinforcement element is maintained in a tensioned configuration by using at least one retention means.

12. The heat exchanger as claimed in claim 11, wherein each header of the pair of spaced apart headers is configured to receive a corresponding tank of the pair of tanks within a peripheral groove thereof, wherein an end portion of each limb of the at least one reinforcement element is adapted to cover at least a part of the peripheral groove of each header of the pair of spaced apart headers.

13. The heat exchanger as claimed in claim 11, wherein an end portion of each limb of the at least one reinforcement element is adapted to cover at least a part of the corresponding header, at least a part of a corresponding crimped profile of the corresponding header formed by crimping between the corresponding header and a corresponding tank.

14. The heat exchanger as claimed in claim 11, wherein the at least one retention means further comprises attaching elements configured at an end portion of each limb of the at least one reinforcement element that are adapted to be crimped over at least a part of the corresponding header, at least a part of a corresponding crimped profile of the corresponding header formed by crimping between the corresponding header and a corresponding tank.

15. The heat exchanger as claimed in claim 11, wherein the at least one retention means further comprises at least one latching element in form of end portions of the limbs that are adapted to engage with at least one corresponding latching element in form of at least a portion of crimped profile configured on the corresponding header.

16. The heat exchanger tank as claimed in claim 11, wherein the wherein at least one reinforcement element is a plurality of reinforcement elements, wherein each reinforcement element is arranged between pairs of the external ribs.

* * * * *